US012263520B1

(12) United States Patent
Pruitt et al.

(10) Patent No.: US 12,263,520 B1
(45) Date of Patent: Apr. 1, 2025

(54) METHOD FOR SECURING A RIVET TO A PLATE

(71) Applicant: US Gov as rep by the Secy of the Air Force, Wright Patterson AFB, OH (US)

(72) Inventors: Melvin Pruitt, Yukon, OK (US); Randy Newman, Tecumseh, OK (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 18/343,576

(22) Filed: Jun. 28, 2023

(51) Int. Cl.
*B21J 15/30* (2006.01)
*B21J 15/04* (2006.01)
*B21J 15/10* (2006.01)

(52) U.S. Cl.
CPC ..... *B21J 15/30* (2013.01); *B21J 15/04* (2013.01); *B21J 15/105* (2013.01)

(58) Field of Classification Search
CPC ..... B21J 15/04; B21J 15/046; B25B 23/0078; B25B 23/0085; F16B 5/04
See application file for complete search history.

(56) References Cited

U.S. PATENT DOCUMENTS 3,222,977 A * 12/1965 Vaughn ..... F16B 19/1063 411/39
3,262,353 A * 7/1966 Waeltz ..... F16B 19/1063 411/39
3,643,544 A * 2/1972 Massa ..... F16B 19/1063 411/937.2
3,711,006 A 1/1973 Conner
4,376,604 A * 3/1983 Pratt ..... F16B 19/1063 411/54
4,406,188 A 9/1983 Mills
4,630,460 A 12/1986 Mauer
4,744,238 A 5/1988 Halbert
4,764,066 A * 8/1988 Terrell ..... F16B 39/28 411/399
4,819,234 A 4/1989 Roberts
4,832,548 A * 5/1989 Strobel ..... F16B 19/1063 411/42
4,904,156 A * 2/1990 Touze ..... F16B 41/002 415/209.2
4,930,206 A 6/1990 Suzuki
5,152,648 A * 10/1992 Pratt ..... F16B 19/1063 411/69
5,405,228 A 4/1995 Reid
(Continued)

*Primary Examiner* — Kyle A Cook
(74) *Attorney, Agent, or Firm* — AFMCLO/JAZ; Larry L. Huston

(57) ABSTRACT

An apparatus and method for securing a rivet to a plate having a frontside and opposed backside with tight clearance. A ductile rivet is inserted through a hole in the plate. The apparatus has a driver with a cone which intercepts a hollow, internally threaded shank of a rivet. An externally threaded fastener is inserted through the diver and threadably engaged with the rivet. The threaded fastener is rotated, compressively drawing the driver into and deforming the rivet circumferentially around the hole. A wrench may be inserted against the backside to hold the hat of the rivet in nonrotatable engagement, thereby enabling the threaded fastener to be axially drawn into the rivet in response to rotation of the threaded fastener relative to the rivet.

12 Claims, 7 Drawing Sheets

(56) References Cited

U.S. PATENT DOCUMENTS

| | | | | |
|---|---|---|---|---|
| 5,702,214 | A | 12/1997 | Duran | |
| 5,954,466 | A * | 9/1999 | Coffey | B25B 23/0085 81/13 |
| 6,899,000 | B1 | 5/2005 | Hsien | |
| 7,059,816 | B2 | 6/2006 | Toosky | |
| 7,293,317 | B2 | 11/2007 | Tsuchiya | |
| 7,516,534 | B2 | 4/2009 | Easterbrook | |
| 10,245,712 | B2 | 4/2019 | Chien | |
| 10,920,812 | B2 | 2/2021 | Avetisian | |
| 2002/0031415 | A1* | 3/2002 | Cosenza | F16B 19/1063 411/34 |
| 2002/0144574 | A1 | 10/2002 | Avetisian | |
| 2002/0176760 | A1* | 11/2002 | Jensen | F16B 5/02 411/34 |
| 2009/0016842 | A1* | 1/2009 | Auriol | F16B 19/1063 411/43 |
| 2011/0010919 | A1* | 1/2011 | Pratt | F16B 19/1063 29/525.01 |
| 2013/0061452 | A1* | 3/2013 | Pratt | F16B 19/1072 411/34 |
| 2014/0334898 | A1* | 11/2014 | Taylor | F16B 35/06 411/413 |
| 2017/0138383 | A1* | 5/2017 | Busby | F16B 19/1072 |
| 2019/0162222 | A1* | 5/2019 | Vovan | F16B 5/02 |
| 2019/0249703 | A1* | 8/2019 | Koontz | F16B 19/1054 |
| 2020/0049185 | A1* | 2/2020 | Quaresma | F16B 19/1063 |
| 2022/0001973 | A1 | 1/2022 | Block | |
| 2022/0184780 | A1* | 6/2022 | Krupey | B25B 23/0085 |
| 2022/0220998 | A1 | 7/2022 | Dubberly | |
| 2023/0250842 | A1* | 8/2023 | Brennetot | F16B 19/1054 29/525.06 |

* cited by examiner

METHOD FOR SECURING A RIVET TO A PLATE

STATEMENT OF GOVERNMENT INTEREST

The invention described and claimed herein may be manufactured, licensed and used by and for the Government of the United States of America for all government purposes without the payment of any royalty.

FIELD OF THE INVENTION

The present invention is related to a method and apparatus for securing a rivet to a plate and more particularly to such a method and apparatus relying solely upon rotational input by a user for securing a rivet to plate having a blind backside.

BACKGROUND OF THE INVENTION

The cockpit and other compartments of modern aircraft have multiple plates with rivets therethrough. The plates are typically made of sheet metal with two opposed surfaces including a frontside which faces a user and has reasonable access. A backside is opposed to the frontside and often has very narrow clearance, preventing convenient access to the backside for attaching the rivet to the plate. The backside is considered to be blind if the user cannot directly view or access the backside.

The rivets are inserted from the frontside, through the respective holes in the plate, then secured thereto. By secured, it is meant that the rivets are held in position without additional welds, adhesive, etc. and remain in position to functionally serve the intended purpose until intentionally removed for maintenance of the component or system proximate the rivet. Once secured, the rivets hold specific components, ancillary systems, etc. to the plate. The plate in turn acts as a chassis for holding the other components and systems in a predetermined and fixed relationship as desired.

Prior art rivets often use a hat and mandrel to attach the rivet to the plate. The hat is inserted through the frontside of the hole with the mandrel oriented towards a user. The mandrel is withdrawn towards the user and ultimately broken or otherwise removed. Withdrawal deforms the hat into a collar juxtaposed with the hole and on the backside of the plate. But this type of rivet does not have the flexibility to accommodate cages, etc. on the backside of the plate which are often useful for securing particular components and systems as needed.

Other attempts in the art utilize a rivet having a hat placed against the backside of the plate and an internally threaded hollow shank extending outwardly through the hole towards the user. A manual tool may be used to deform the shank of the rivet against the frontside of the plate. Such manual tools use a telescoping tube to attach to the shank of the rivet and withdraw the rivet towards the frontside, thereby deforming the rivet for securement. But these manual tools are time consuming and unreliable.

Common aircraft may have 50 or more such rivets to be attached during routine maintenance. If a rivet breaks or is improperly attached maintenance is repeated extended. Maintenance costs escalate and readiness is adversely affected. Some of these aircraft have been in service since the 1970's, requiring hundreds, or thousands, of rivet attachments over a period of decades. It can be seen there is a long felt need for improved maintenance procedures and tools for securing rivets to plates and particularly for securing rivets to plates having a blind backside or backside with a tight clearance.

SUMMARY OF THE INVENTION

In one embodiment the invention comprises a method of securing a rivet to a plate. The method comprising the steps of: providing a plate having a plate hole therethrough, the plate having a backside and a frontside opposed thereto; nonrotatably disposing a rivet having a having an internally threaded rivet hole therethrough and being complementary to the plate hole, the rivet having a hat disposed on the backside and a shank extending longitudinally from the hat and outwardly from the frontside of the plate; inserting the shaft of an externally threaded fastener into the internally threaded rivet hole, the threaded fastener being rotatably disposed in a bore of an elongate driver having a cone at a first end and a heel at a second opposed thereto, the threaded fastener having a head larger juxtaposed with the heel and being larger than the diameter of the bore of the elongate driver; and axially rotating the threaded fastener to thereby draw the cone of the elongate driver into the rivet hole whereby the cone intercepts a circumference of the rivet hole to deform the rivet about the frontside of the plate.

In another embodiment the invention comprises a method of securing a rivet to a plate, the method comprising the steps of: providing a stationary plate having a plate hole therethrough, the plate having a backside and a frontside opposed thereto; nonrotatably disposing a rivet having a having an internally threaded rivet hole therethrough and being complementary to the plate hole, the rivet having a hat disposed on the backside and a shank extending longitudinally from the hat and outwardly from the frontside of the plate; providing a threaded fastener having a head and a shaft externally threaded to be complementary to the internally threaded rivet hole and an elongate driver having a bore therethrough with a cone at a first end thereof and a heel at an opposed second end thereof, the bore being smaller than the head; inserting the externally threaded shaft of through the bore until the head is in contact with the heel preventing the threaded fastener from passing through the bore; threading the shaft of the externally threaded fastener into the internally threaded rivet hole hand tight until the cone contacts the shank of the rivet; and axially rotating the threaded fastener to thereby draw the cone of the elongate driver into deformable contact with the shank of the rivet to form a collar proximate the plate hole and thereby prevent the rivet from passing therethrough.

In another embodiment the invention comprises a kit for attaching a rivet to a through hole of a plate, the kit comprising: a tool; and a wrench, the tool comprising an elongate driver having a first end and a second end opposed thereto, the driver having a bore therethrough, the bore being concentric with and defining a longitudinal axis, the driver having a heel disposed on the second end thereof and being orthogonal to the longitudinal axis, the driver having a cone on the first end and being orthogonal to the longitudinal axis and a threaded fastener having a head and an externally threaded shaft joined at a proximal end thereto and extending to a distal end spaced therefrom, the threaded fastener being configured so that the shaft rotatably fits within the bore concentric to the longitudinal axis and the head rotatably abuts the heel, the threaded fastener being sized to threadably engage the internal threads of a complementary rivet, and the wrench comprising an elongate handle and an open jaw joined thereto, the open jaw being sized to frictionally engage a hat of the complementary rivet.

DETAILED DESCRIPTION OF THE INVENTION

Figure 1A:
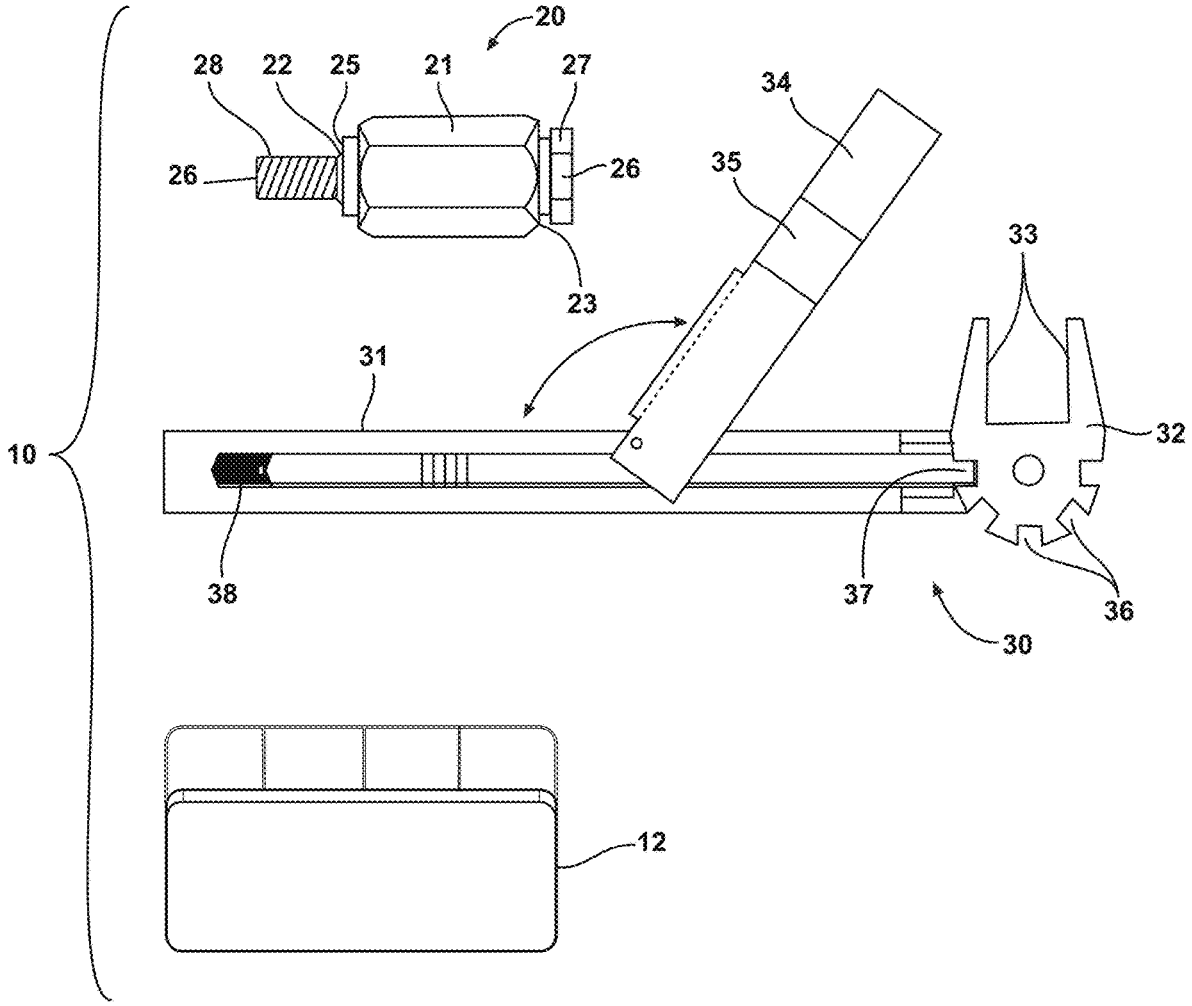
FIG. 1A is a scale top plan view of a kit according to the present invention having an optional storage box.
Figure 1B:
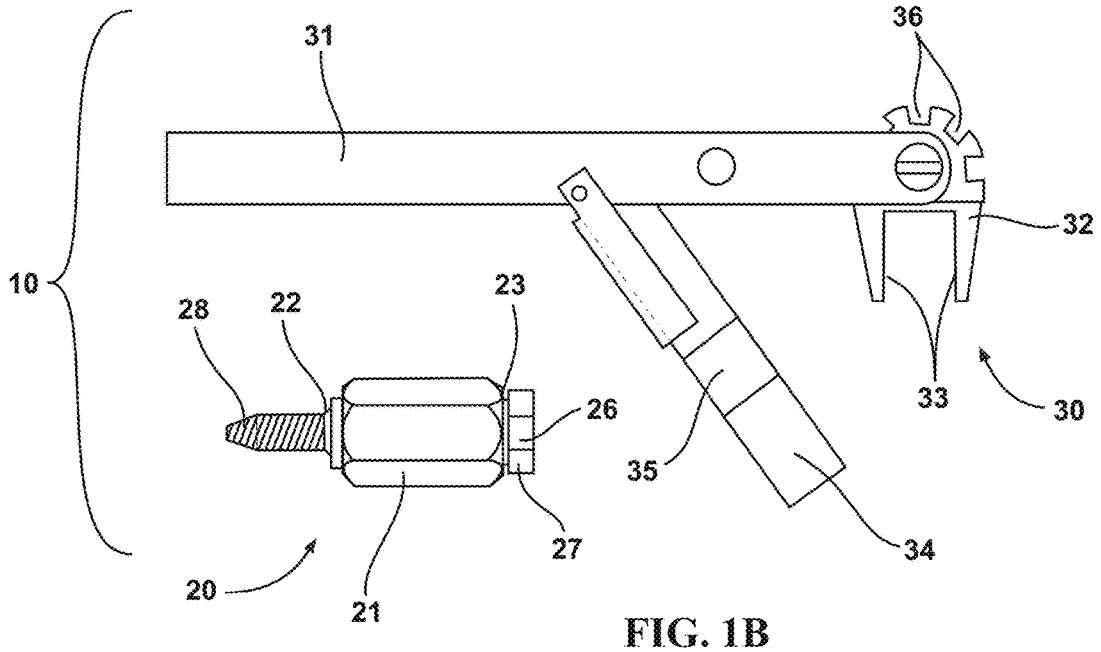
FIG. 1B is a scale bottom plan view of the kit of claim 1 having the storage box omitted for clarity.
Figure 1C:
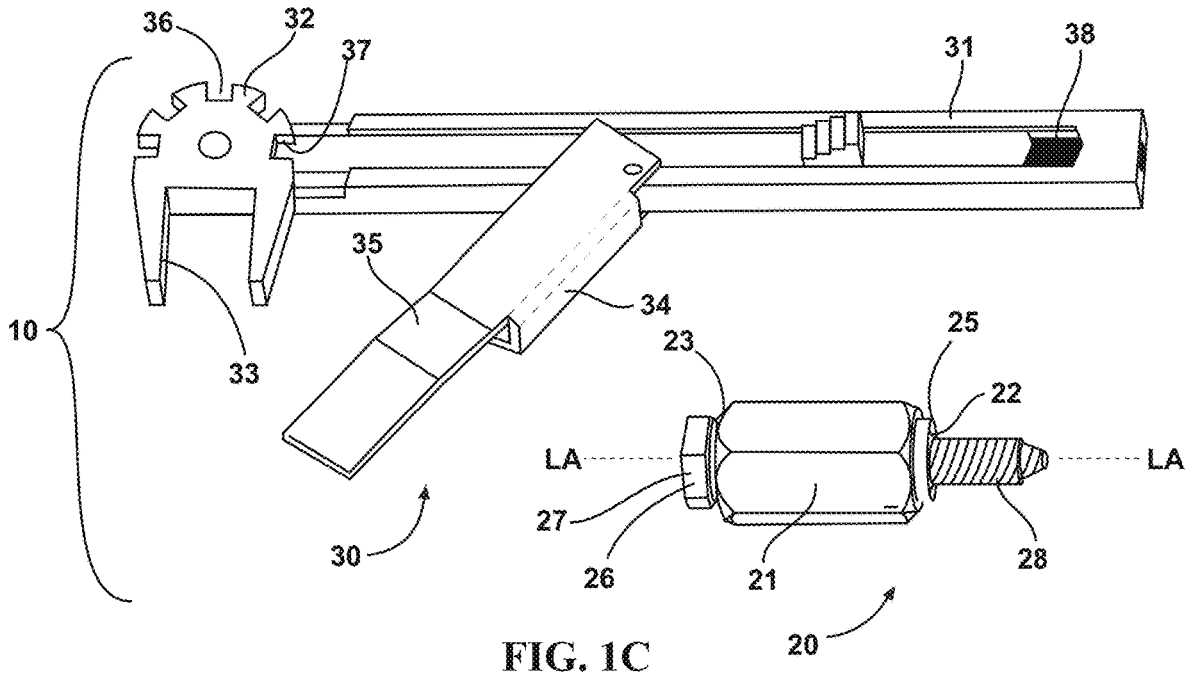
FIG. 1C is a scale perspective view of the kit of claim 1 having the storage box omitted for clarity.

Referring to FIG. 1A, FIG. 1B and FIG. 1C, in one aspect the invention comprises a kit 10 for securing a rivet 40 to a plate 15. The kit 10 comprises a tool 20 and a wrench 30, each having multiple components. The kit 10 may comprise an optional storage box 12, which forms no part of the claimed invention except as may be specifically claimed below. The tool 20 comprises an elongate driver 21 having a bore 24 defining a longitudinal axis LA and threaded fastener 26 insertable therein. The driver 21 and threaded fastener 26 are configured for axial rotation therebetween. The wrench 30 comprises an elongate handle 31 and jaw 32. The jaw 32 is configured to prevent rotation of a rivet 40 about the longitudinal axis LA.

The optional storage box 12 may have a single compartment or plurality of compartments. The compartment(s) may be used for transport and storage of the tool 20, wrench 30, rivets 40, and other items which are helpful to the task under consideration. The optional storage box 12 may have a closure for retention of items therein.

Figure 2A:
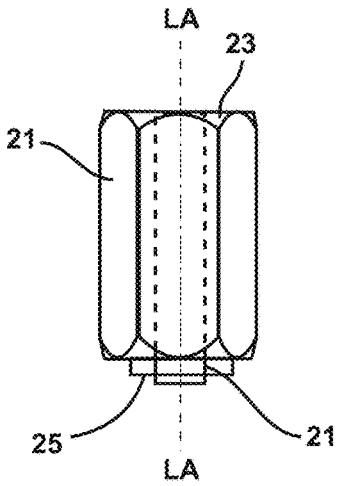
FIG. 2A is a scale profile view of a driver usable with the present invention.
Figure 2B:
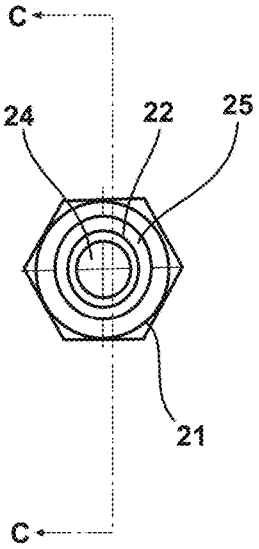
FIG. 2B is a scale frontal view of the driver of FIG. 2A.
Figure 2C:
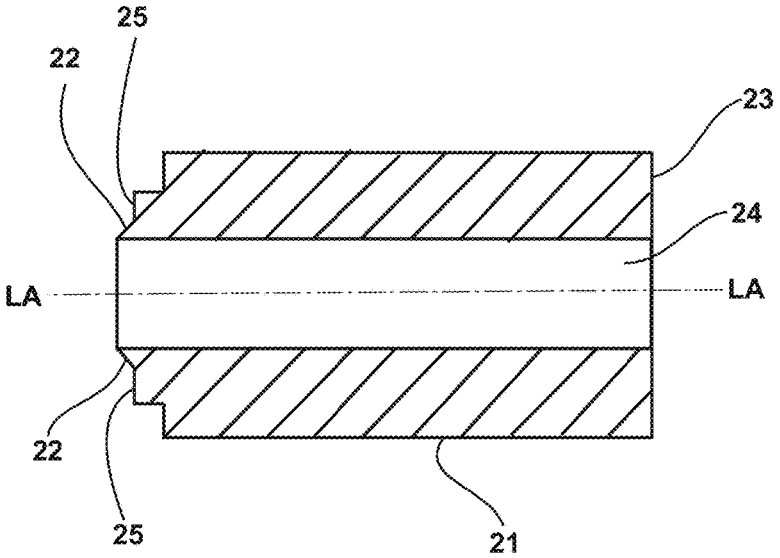
FIG. 2C is a scale sectional view of the driver of FIG. 2A taken along lines C-C of FIG. 2B and having a schematic threaded fastener not shown to scale.

Referring to FIG. 2A, FIG. 2B and FIG. 2C and examining the invention in more detail, the tool 20 comprises a threaded fastener 26. The threaded fastener 26 has a head 27 and an externally threaded shaft 28 joined thereto at a proximal end and extending outwardly therefrom to a distal end. The shaft 28 is sized with a diameter to fit inside the bore 24 of the driver 21 concentric to the longitudinal axis LA. The head 27 is sized to prevent entrance into the bore 24 and may have a hex configuration as is known in the art. The threaded fastener 26 may have a length which protrudes 2 to 4 shaft 28 diameters outwardly of the driver 21 to engage the rivet 40 as discussed below. The threaded fastener 26 is sized with threads that are complementary to the internal threads of the rivet 40 to be secured. For an exemplary configuration the threaded fastener 26 may be a 3/16 inch×16×1 3/8 inch SS hex bolt.

If desired, the shaft 28 of the threaded fastener 26 may be slightly tapered as the distal end is approached. The taper should not be so great as to prevent engagement of external shaft 28 threads with the complementary internal rivet 40 threads, but allow for gradual radial deformation of the shank 42 of the rivet 40 as the driver 21 advances in the forward direction.

The driver 21 is longitudinally elongate and may be axisymmetric about the longitudinal axis LA. The driver 21 advantageously having no moving parts. The driver 21 has a cone 22 at a first end and a heel 23 at a longitudinally opposed second end. The heel 23 provides an anvil for retention of the head 27 of the threaded fastener 26 and may be perpendicular to the longitudinal axis LA. Advance of the threaded fastener 26 in the longitudinal axis LA urges the head 27 of the threaded fastener 26 against the heel 23 of the driver 21, thereby urging the driver 21 in the forward axial direction. The forward direction is towards the rivet 40 to be secured.

The bore 24 of the driver 21 is sized to accept the shaft 28 of the threaded fastener 26. The threaded fastener 26 is axially rotatable relative to the driver 21 but not so loos as to adversely affect concentricity of the threaded fastener 26 relative to the longitudinal axis LA.

The cone 22 tapers in the forward direction. The inside radius of the cone 22 may match the bore 24 and the cone 22 may have a cone 22 radius which is the outer radius of the cone 22. Circumscribing the cone 22 radius is a shoulder 25 which is a perpendicular to the longitudinal axis LA. The cone 22 has an inner radius sized to closely fit inside the hole of the rivet 40. As the driver 21 advances forward, as urged by the threaded fastener 26, the cone 22 intercepts the inside of the hole of the rivet 40 and causes radially expansive deformation thereof.

The cone 22 is preferably axisymmetric and concentric with respect to the shaft 28 of the externally threaded fastener 26, may have an included angle of 45 to 65 degrees and a shoulder 25 radius of 0.045 inches to 0.055 inches and a cone 22 radius of 0.033 inches to 0.045 inches, it being understood that the cone 22 radius will correspond to the inner radius of the shoulder 25. The driver 21 may be machined from 18-8 SS hex stock or comprise other cross sections as desired.

Figure 3A:
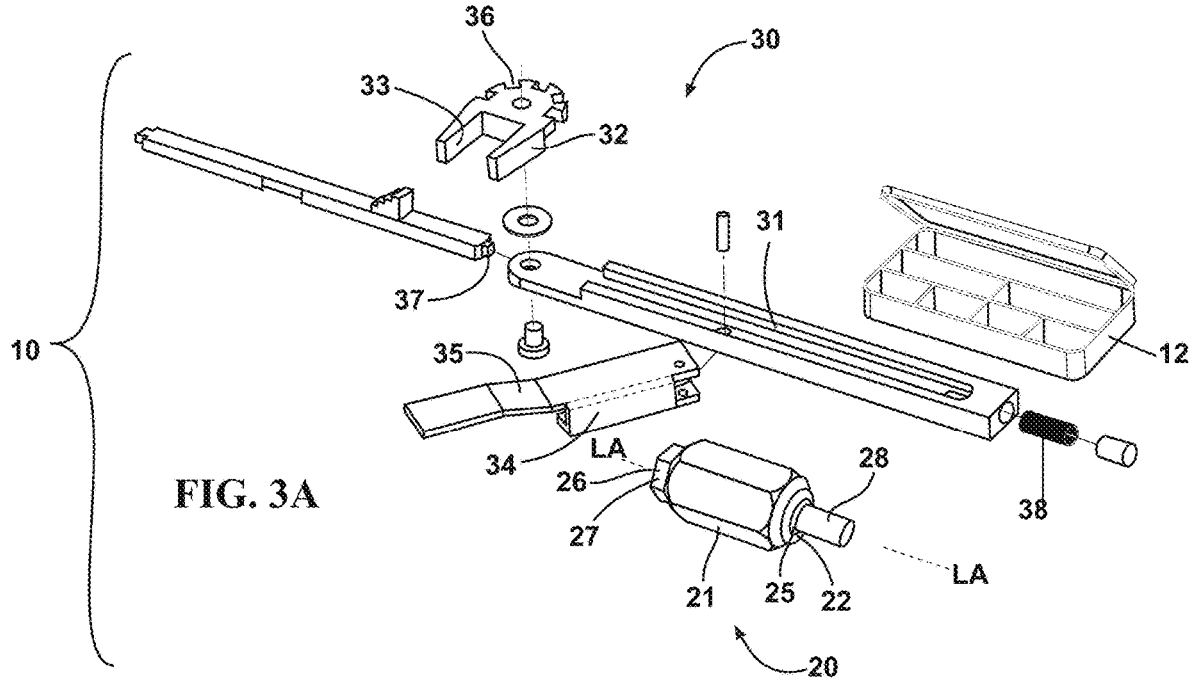
FIG. 3A is a scale exploded perspective view of the wrench in the kit of FIG. 1A.
Figure 3B:
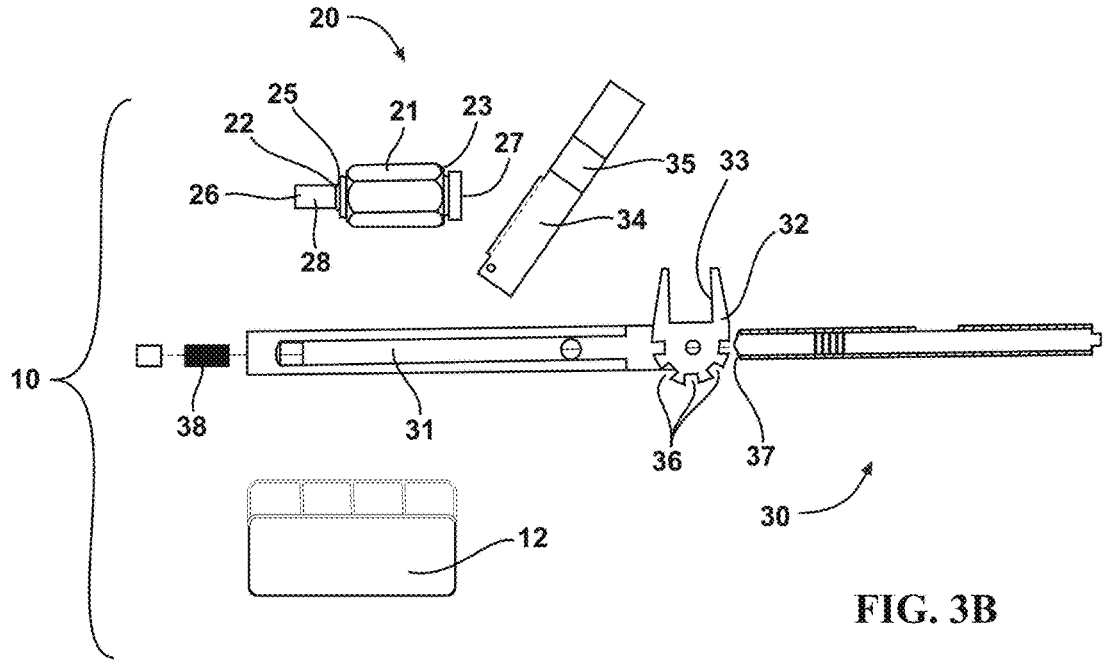
FIG. 3B is a scale exploded top plan view of the wrench in the kit of FIG. 3A.

Referring to FIG. 3A and FIG. 3B, the wrench 30 and open jaw 32 function together to prevent rotation of the rivet 40 during securement. The handle 31 of the wrench 30 is elongate, has a proximal end suitable for gripping by the user and a distal end remote therefrom. The jaw 32 has opposed flats 33 sized to removably accept the hat 41 of the rivet 40 therein and resist rotation of the rivet 40 while the shank 42 is circumferentially expanded outward of the hole. The jaw 32 may comprise an open ended wrench 30 configuration as is known in the art.

The jaw 32 is juxtaposed with the distal end of the handle 31. The jaw 32 may be pivotally and lockably disposed in plural angular relationships relative to the elongate handle 31. The jaw 32 may be crenulated with notches 36 and the handle 31 have a protrusion 37 complementary thereto. The user retracts the protrusion 37 towards the proximal end of the handle 31, rotatably pivots the jaw 32 until the desired angular relationship for the particular rivet 40 under consideration occurs and then extends the protrusion 37 towards the distal end to engage the notch and prevent unintended rotation of the jaw 32. The protrusion 37 may be biased towards the distal end of the handle 31 by a spring 38 to prevent unintended disengagement of the protrusion 37 from the notch.

Optionally, the wrench 30 may have a brace 34 with a proximal end articulably attached to the handle 31 and configured to articulate outwardly therefrom. The brace 34 may have an offset 35 so that the brace 34 can intercept an edge 18, or preferably the frontside 16 of a stationary plate 15 and require less effort on behalf of the user to resist torque applied during securement. The offset 35 can also be pressed against the frontside 16 of the plate 15 for stability. The brace 34 may be collapsed against the handle 31 for storage or manipulation of the wrench 30.

Figure 4A:
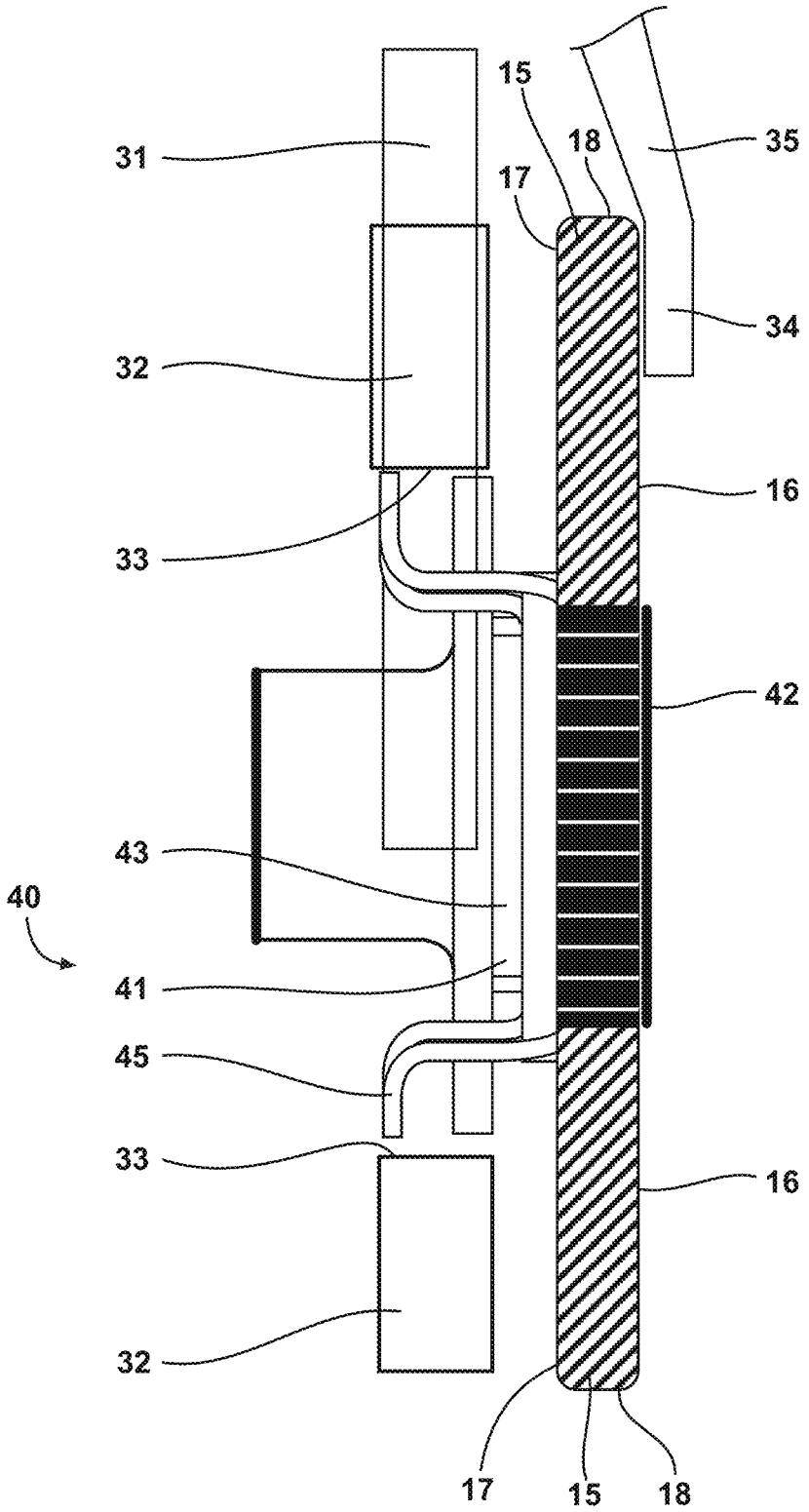
FIG. 4A is a scale side elevational view of a fragmentary plate having a hole therethrough and a rivet therein.

Referring to FIG. 4A, in use a ductile rivet 40 may have a hat 41 with an annulus 43 disposed against a backside 17 of the stationary plate 15 and a shank 42 extending outward of the frontside 16 of hole in the plate 15. The annulus 43 extends radially outboard of and preferably circumscribing the hole. The annulus 43 is preferably perpendicular to the longitudinal axis LA. The annulus 43 may have serrations for gripping the backside 17 of the plate 15. The hat 41 may have a cage 45 for use with other components and systems as is known in the art.

Figure 4B:
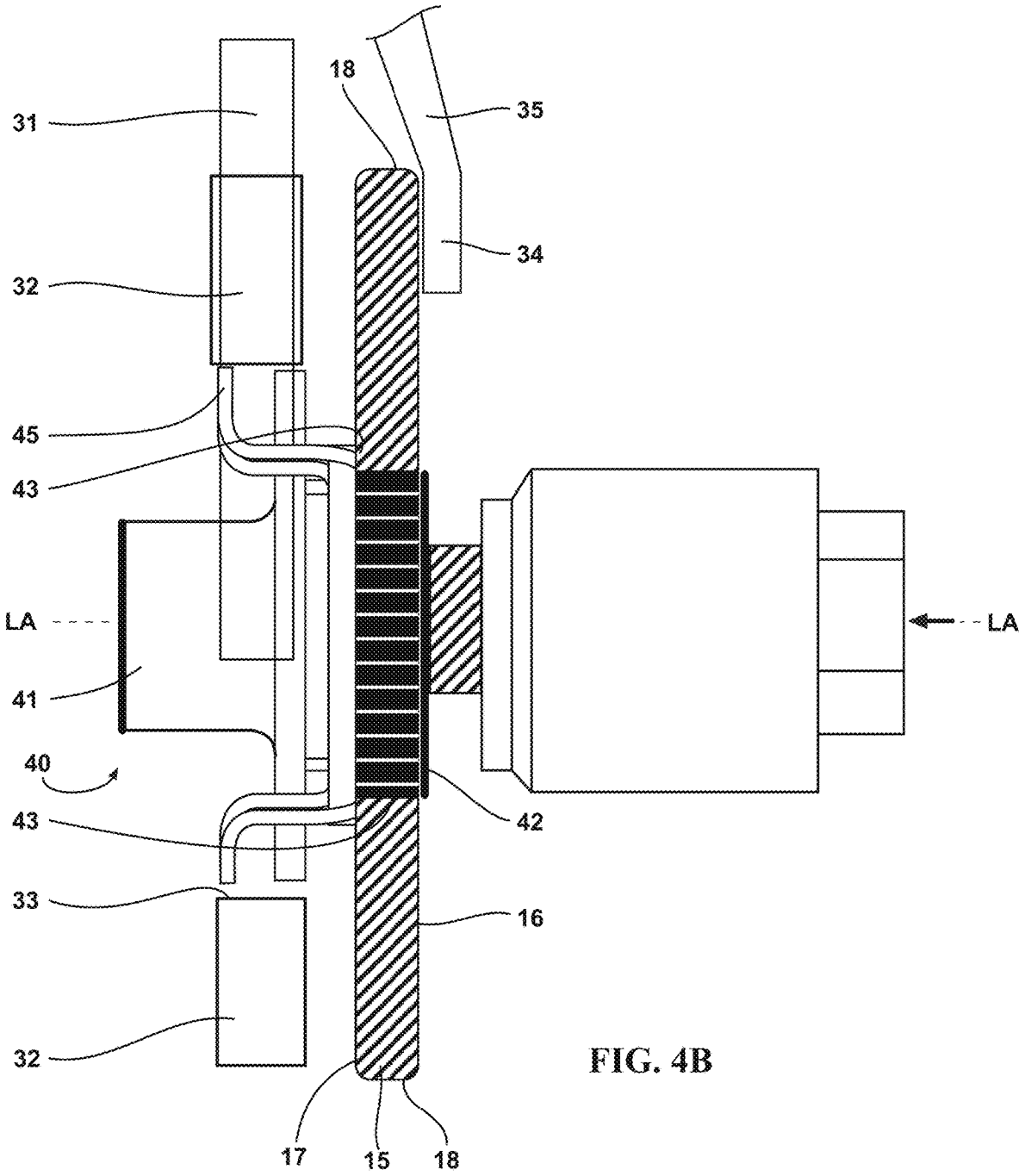
FIG. 4B is a scale side elevational view of the fragmentary plate and rivet of FIG. 4A and showing a scale driver for deformation of the rivet according to the process of the present invention with a schematic threaded fastener.

Referring to FIG. 4B, the rivet 40 has a hole therethrough. The hole is internally threaded, parallel to and concentric with the longitudinal axis LA. The threaded fastener 26 has external threads complementary to, is rotatably inserted in the bore 24 of the driver 21 and threadably engaged with the internally threaded hole of the rivet 40.

Further rotation of the threaded fastener 26 converts the axial rotation of the threaded fastener 26 to longitudinal advance in the direction of the arrow. The head 27 of the threaded fastener 26 contacts the heel 23 of the driver 21 and longitudinally advances the cone 22 of the driver 21 into the ductile shank 42 of the rivet 40. The hat 41 is held by the wrench 30 to apply counter-torque to the rivet 40 and prevent rotation of the rivet 40 while the cone 22 is driven into the shank 42 of the rivet 40.

The threaded fastener 26 may advantageously be rotated less than 10 revolutions and preferably less than 5 revolutions to secure the rivet 40 to the plate 15. The rotation may longitudinally advance the drive forward a distance of 0.03 inches to 0.010 inches and preferably 0.04 inches to 0.07 inches.

Optionally a washer may be interposed in known fashion between the head 27 and the heel 23 to accommodate the moving interface and reduce friction. The threaded fastener 26 may be driven by a hex socket and ratchet wrench 30 as is known in the art, driven pneumatically using air tools, driven using battery powered tools, etc.

Figure 4C:
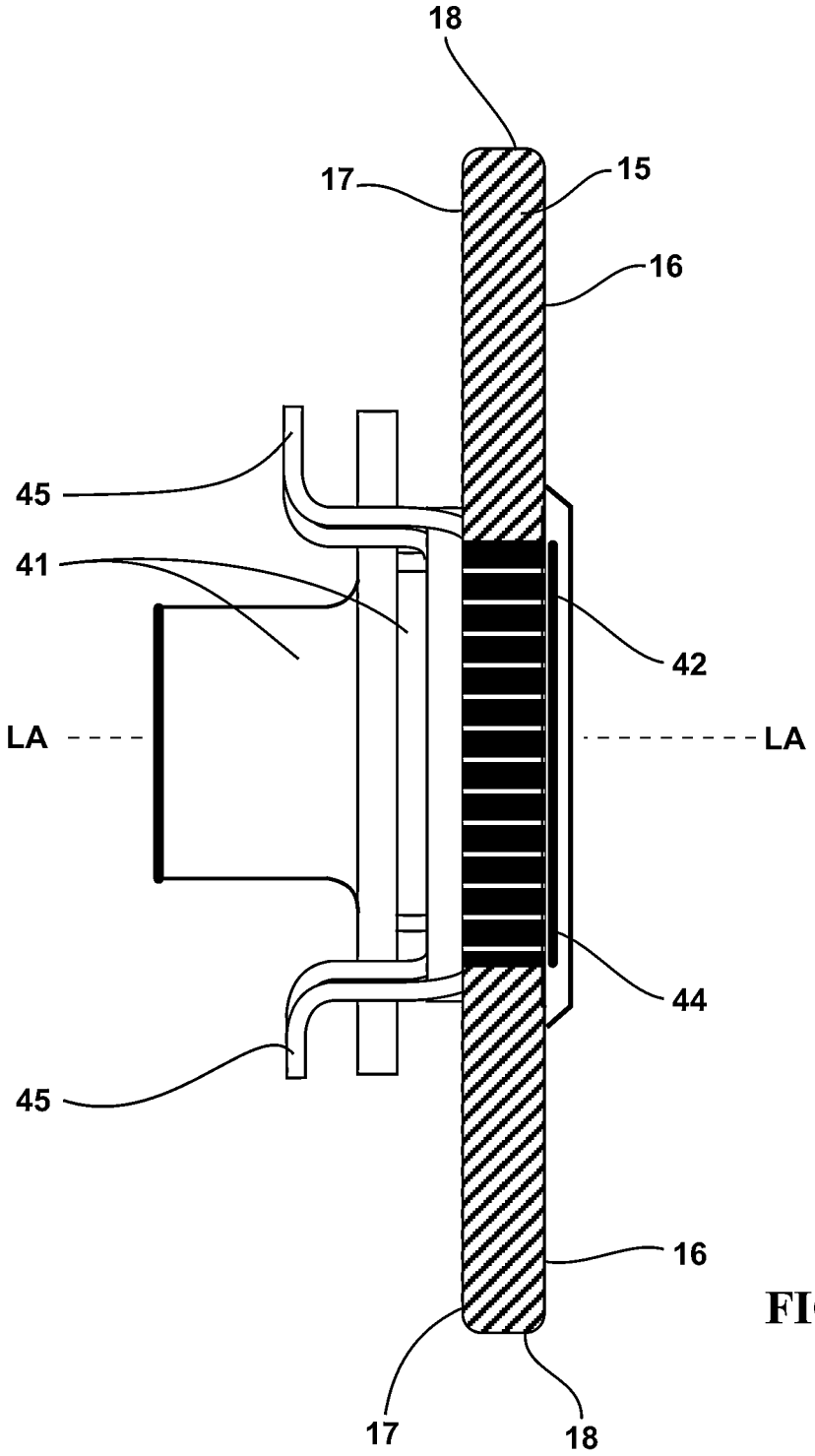
FIG. 4C is a scale side elevational view of the fragmentary plate and rivet of FIG. 4A showing the collar which secures the rivet to the plate.

Referring to FIG. 4C, the cone 22 of the driver 21 radially and expansively deforms the hollow shank 42 of the rivet 40 onto the front side of the plate 15. This deformation causes a collar 44 to be formed outboard of and preferably circumscribing the hole through the plate 15. The collar 44 is formed from the ductile material of the shank 42 extending outward of the frontside 16 being compressed to a radial configuration against the frontside 16. The inner radius of the collar 44 corresponds to the hole through the plate 15 and the outer radius of the collar 44 is a collar 44 radius preventing withdrawal of the collar 44 through the plate 15 and thereby securing the rivet 40 to the plate 15.

Upon securement the threaded fastener 26 is unscrewed from the rivet 40 in the counter direction. Unscrewing the threaded fastener 26 allows the tool 20 to be used for subsequent operations without further restoration or additional steps to prepare the tool 20 for the next operation.

The kit 10 may comprise a plurality of tools 20 and/or wrenches 30 of the same size or different sizes. Such a kit 10 provides the flexibility to be used with various sizes and configurations of rivets 40.

All values disclosed herein are not strictly limited to the exact numerical values recited. Unless otherwise specified, each such dimension is intended to mean both the recited value and a functionally equivalent range surrounding that value. For example, a dimension disclosed as "40 mm" is intended to mean "about 40 mm." Every document cited herein, including any cross referenced or related patent or application, is hereby incorporated herein by reference in its entirety unless expressly excluded or otherwise limited. The citation of any document or commercially available component is not an admission that such document or component is prior art with respect to any invention disclosed or claimed herein or that alone, or in any combination with any other document or component, teaches, suggests or discloses any such invention. Further, to the extent that any meaning or definition of a term in this document conflicts with any meaning or definition of the same term in a document incorporated by reference, the meaning or definition assigned to that term in this document shall govern. All limits shown herein as defining a range may be used with any other limit defining a range of that same parameter. That is the upper limit of one range may be used with the lower limit of another range for the same parameter, and vice versa. As used herein, when two components are joined or connected the components may be interchangeably contiguously joined together or connected with an intervening element therebetween. A component joined to the distal end of another component may be juxtaposed with or joined at the distal end thereof. While particular embodiments of the present invention have been illustrated and described, it would be obvious to those skilled in the art that various other changes and modifications can be made without departing from the spirit and scope of the invention and that various embodiments described herein may be used in any combination or combinations. It is therefore intended the appended claims cover all such changes and modifications that are within the scope of this invention.

What is claimed is:

1. A method of securing a rivet to a plate, the method comprising the steps of:

providing a plate having a plate hole therethrough, the plate having a backside and a frontside opposed thereto;

nonrotatably disposing a rivet through the plate hole, the rivet having an internally threaded rivet hole and being complementary to the plate hole, the rivet having a hat disposed on the backside and a shank extending longitudinally from the hat and outwardly from the frontside of the plate;

inserting the shaft of an externally threaded fastener into the internally threaded rivet hole, the threaded fastener being rotatably disposed in a bore of an elongate driver having a cone at a first end and a heel at a second end opposed thereto, the threaded fastener having a head larger than and juxtaposed with the heel and being larger than the diameter of the bore of the elongate driver; and axially rotating the threaded fastener to thereby draw the cone of the elongate driver into the rivet hole whereby the cone intercepts a circumference of the rivet hole to deform the rivet about the frontside of the plate.

2. The method according to claim 1 further comprising the step of unscrewing the threaded fastener from the internally threaded rivet to thereby remove the driver from the rivet.

3. The method according to claim 1 wherein the step of axially rotating the threaded fastener comprises rotating the threaded fastener to axially draw the driver forward a distance of 0.03 inches to 0.07 inches to thereby deform the shank of the rivet radially outward.

4. The method according to claim 3 comprising the step of rotating the threaded fastener less than 5 revolutions.

5. The method according to claim 1 wherein the step of nonrotatably disposing the rivet with the hat disposed on the backside of the plate comprises the step of securing the hat of the rivet against rotation using a wrench.

6. The method according to claim 5 wherein the step of securing the hat using the wrench comprises the step of inserting the hat between opposed flats of a jaw of the wrench and securing the wrench against axial rotation.

7. The method according to claim 6 wherein the step of securing the wrench against rotation comprises the step of angularly fixing the jaw of the wrench with respect to a handle of the wrench before inserting the hat between the opposed flats.

8. The method according to claim 7 further comprising the step of disposing a brace articulably attached to the handle of the wrench against the frontside of the plate to prevent rotation of the jaw of the wrench relative to the rivet.

9. A method of securing a rivet to a plate, the method comprising the steps of:

providing a stationary plate having a plate hole therethrough, the plate having a backside and a frontside opposed thereto;

nonrotatably disposing a rivet through the plate hole, the rivet having an internally threaded rivet hole being complementary to the plate hole, the rivet having a hat disposed on the backside and a shank extending longitudinally from the hat and outwardly from the frontside of the plate;

providing a threaded fastener having a head and a shaft externally threaded to be complementary to the internally threaded rivet hole and an elongate driver having a bore therethrough with a cone at a first end thereof and a heel at an opposed second end thereof, the bore being smaller than the head;

inserting the externally threaded shaft through the bore until the head is in contact with the heel preventing the threaded fastener from passing through the bore;

manually providing a torque necessary for threading the shaft of the externally threaded fastener into the internally threaded rivet hole until the cone contacts the shank of the rivet; and axially rotating the threaded fastener to thereby draw the cone of the elongate driver into deformable contact with the shank of the rivet to cause the shank to form a collar proximate the plate hole, circumscribing the plate hole and thereby preventing the rivet from passing therethrough, and further comprising the step of using an edge of the stationary plate to support a wrench in contacting relationship with the hat of the rivet to resist movement of the of the rivet during axial rotation of the threaded fastener.

10. The method according to claim 9 wherein the rivet has an annulus in contacting relationship with the backside of the plate, the annulus having a plurality of serrations thereon.

11. The method according to claim 9 further comprising the step of axially rotating the threaded fastener until a shoulder circumscribing the cone of the driver deformably contacts a shoulder of the rivet.

12. The method according to claim 11 wherein the collar has a collar radius of 0.045 inches to 0.055 inches.

* * * * *